US006941091B2

(12) United States Patent
Iida et al.

(10) Patent No.: US 6,941,091 B2
(45) Date of Patent: Sep. 6, 2005

(54) IMAGE FORMING APPARATUS AND IMAGE FORMING METHOD WITH PAPER CLEANING DEVICE

(75) Inventors: Atsuko Iida, Kanagawa-ken (JP); Mitsunaga Saito, Chiba-ken (JP); Hideki Nukada, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 20 days.

(21) Appl. No.: 10/254,589

(22) Filed: Sep. 26, 2002

(65) Prior Publication Data

US 2003/0059226 A1 Mar. 27, 2003

(30) Foreign Application Priority Data

Sep. 27, 2001 (JP) ..... P2001-297418

(51) Int. Cl.[7] ..... G03G 21/00
(52) U.S. Cl. ..... 399/99; 399/101
(58) Field of Search ..... 399/99, 101, 302, 399/308, 390

(56) References Cited

U.S. PATENT DOCUMENTS

| | | | | |
|---|---|---|---|---|
| 3,993,022 A | * | 11/1976 | Zimmer | 399/99 |
| 4,370,050 A | * | 1/1983 | Matsui et al. | 399/99 |
| 4,696,565 A | | 9/1987 | Imanaka | |
| 4,750,018 A | * | 6/1988 | Gooray et al. | 399/390 |
| 4,878,657 A | * | 11/1989 | Ura et al. | 271/9.13 |
| 5,343,277 A | | 8/1994 | Rooijakkers et al. | |
| 5,359,394 A | * | 10/1994 | Ogawa et al. | 399/390 |
| 5,436,700 A | * | 7/1995 | Kikuchi et al. | 399/111 |
| 6,201,940 B1 | * | 3/2001 | Lee | 399/101 |

FOREIGN PATENT DOCUMENTS

| | | | | |
|---|---|---|---|---|
| CN | 86 1 04959 A | | 2/1987 | |
| JP | 06337598 A | * | 12/1994 | G03G/15/16 |
| JP | 11-052641 | | 2/1999 | |
| JP | 11-231685 | | 8/1999 | |
| JP | 11-352819 | | 12/1999 | |
| JP | 3064112 | | 5/2000 | |

* cited by examiner

*Primary Examiner*—Robert Beatty
(74) *Attorney, Agent, or Firm*—Oblon, Spivak, McClelland, Maier & Neustadt, P.C.

(57) ABSTRACT

The image forming apparatus in accordance with the present invention comprises an image forming substrate for forming an electrostatic latent image on a surface of the image forming substrate; a developing device supplying liquid developer to the electrostatic latent image to form a developed image on the image forming substrate; an intermediate transfer medium having a primary transferring position to which the developed image on the image forming substrate is transferred primarily by contacting the image forming substrate and a secondary transferring position transferring secondarily the developed image to a paper by contacting the paper; an intermediate transfer medium cleaning device adhering and removing material stuck to a surface of the intermediate transfer medium, which contacts in a place after passing through the secondary transferring position and before passing through primary transferring position; and a paper cleaning device positioned in a conveying path of a conveying device to transport the paper to the secondary transferring position, and adhering and removing material stuck to a contact surface of the paper to the intermediate transfer medium by contacting the contact surface, in order to prevent paper dust etc. stuck to the paper from adhering to the intermediate transfer medium when the secondary transferring step is carried out.

26 Claims, 5 Drawing Sheets

(TABLE 1)

| HARDNESS OF URETHANE RUBBER | ADHESION (gf/mm²) |
|---|---|
| | 5 |
| 6 | 3.7 |
| 16 | 3.2 |
| 28 | 2.5 |
| 39 | 2.1 |
| 50 | 1.6 |
| 56 | 1.2 |
| UNDER 70 | 0.75 |

(TABLE 2)THE RELATION BETWEEN STRUCTURE AND EXCHANGE LIFE OF AN INTERMEDIATE CLEANING ROLLER

| STRUCTURE | EXCHANGE LIFE OF THE INTERMEDIATE CLEANING ROLLER |
|---|---|
| INTERMEDIATE CLEANING ROLLER | 100K SHEET OF PAPER |
| INTERMEDIATE CLEANING ROLLER +CLEANING BLADE | 120K SHEET OF PAPER |
| INTERMEDIATE CLEANING ROLLER +CLEANING BLADE+OIL COATING ROLLER | 150K SHEET OF PAPER |

IMAGE FORMING APPARATUS AND IMAGE FORMING METHOD WITH PAPER CLEANING DEVICE

CROSSREFERENCE TO RELATED APPLICATIONS

This application is based upon and claims the benefit of priority from the prior Japanese Patent Application No. 2001-297418, filed on Sep. 27, 2002; the entire contents of which are incorporated herein reference.

BACKGROUND OF THE INVENTION

1. Field of the Invention

This invention relates to an image forming apparatus and an image forming method in which a developed image is formed with liquid developers which contain toner particles and liquid carrier.

2. Description of the Related Art

As an image forming apparatus which gets a visible image by using liquid developer, an apparatus transferring secondarily a developed image formed on a photosensitive medium to a paper by means of intermediate transfer medium has already been developed. In the image forming apparatus using the intermediate transfer medium, a cleaning mechanism is provided to improve the quality of image as disclosed by the Japanese Patent Publication No. 2001-13838. The cleaning mechanism employs a cleaner to adhere stuck material on the intermediate transfer medium with the aid of adherence thereof.

For example, as shown in FIG. 1, an intermediate transfer roller 3 to transfer secondarily a full-color-developed image, which is primarily transferred from photosensitive drum 2 of an image forming portion 1 of the image forming apparatus, contacts an intermediate transfer cleaning roller 4 having a surface adhering layer of a resin which is the same kind as that of toner particles of the developing agent, in order to remove stuck material on the surface of an intermediate transfer roller 3 by contacting them closely on an intermediate transfer cleaning roller 4 side, after the secondary transferring step has finished.

However the above-mentioned intermediate transfer cleaning roller 4 cannot maintain adherence of the surface adhering layer thereof for a long period, therefore there is a problem that maintainability or economical efficiency is deteriorated because long durability is prevented due to deterioration of adherence of the surface adhering layer. This deterioration of the adherence of the intermediate transfer cleaning roller 4 is caused by the fact that some dust consisting mainly of paper powder stuck on a paper P as well as residual toner is adhered to the surface of the intermediate transfer roller 3 after the secondary transferring step has finished, and that the dust adheres to the intermediate transfer cleaning roller 4 side.

Therefore, it is desirable that an image forming apparatus and an image forming method with excellent maintainability and economical efficiency, which prevent the adherence of the intermediate transfer cleaning device from deteriorating so as to be able to clean the intermediate transfer medium favorably for a long time, should be realized.

SUMMARY OF THE INVENTION

An object of the present invention is intended to provide an image forming apparatus and an image forming method with excellent maintainability and economical efficiency, which preserves good adherence of the intermediate transfer cleaning device for a long period, as well as improving the quality of image thanks to good cleaning.

In accordance with an embodiment of the present invention, an image forming apparatus comprises: an image forming material for forming an electrostatic latent image on a surface thereof; a developing device supplying liquid developer to the electrostatic latent image to form a developed image on the image forming material; an intermediate transfer medium having a primary transferring position to which the developed image on the image forming material is transferred primarily by contacting the image forming material and a secondary transferring position transferring secondarily the developed image to a paper by contacting the paper; an intermediate transfer cleaning device adhering and removing material stuck to a surface of the intermediate transfer medium by contacting the intermediate transfer medium when the intermediate transfer medium has passed through the secondary transferring position but has not reached the primary transferring position yet; and a paper cleaning device positioned in a conveying path of a conveying device to transport the paper to the secondary transferring position, and adhering and removing material stuck to a contact surface of the paper to the intermediate transfer medium by contacting the contact surface.

Further in accordance with to the embodiment of the present invention, an image forming apparatus comprises: an image forming material for forming an electrostatic latent image on a surface thereof; a developing device supplying liquid developer to the electrostatic latent image to form a developed image on the image forming material; an intermediate transfer roller having a primary transferring position to which the developed image on the image forming material is transferred primarily by contacting the image forming material and a secondary transferring position transferring secondarily the developed image to a paper by contacting the paper; an intermediate transfer cleaning roller adhering and removing material stuck to a surface of the intermediate transfer roller by contacting the intermediate transfer roller when the intermediate transfer roller has passed through the secondary transferring position but has not reached the primary transferring position yet; and a paper cleaning roller positioned in a conveying path of a conveying device to transport the paper to the secondary transferring position, and adhering and removing material stuck to a contact surface of the paper to the intermediate transfer roller by contacting the contact surface.

In accordance with further embodiment of the present invention, an image forming method comprises: a developing step to form a developed image by supplying liquid developer to an electrostatic latent image formed on an image forming material; a primary transferring step to transfer the developed image from the image forming material to an intermediate transfer medium by contacting the intermediate transfer medium with the image forming material; a secondary transferring step to transfer the developed image from the intermediate transfer medium to a paper by contacting the paper with the intermediate transfer medium; a paper cleaning step to adhere material stuck to a contact surface of the paper to the intermediate transfer medium by contacting a paper cleaning device to the contact surface of the paper before the contact surface of the paper reaches the contact position to the intermediate transfer medium; and an intermediate transfer cleaning step to adhere and remove material stuck to the surface of the intermediate transfer medium by contacting a intermediate transfer cleaning device to the intermediate transfer medium after the secondary transferring step has finished.

DETAILED DESCRIPTION OF THE INVENTION

Figure 1:
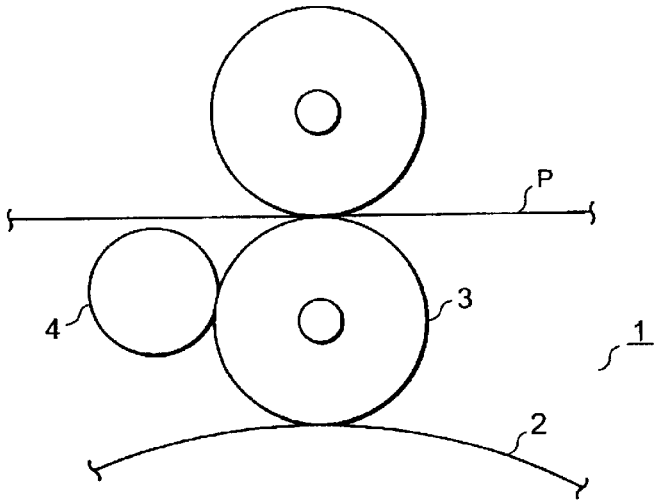
FIG.1 (PRIOR ART)
FIG. 1 is a schematic structural diagram showing a part of an image forming portion of a conventional image forming apparatus.
Figure 2:
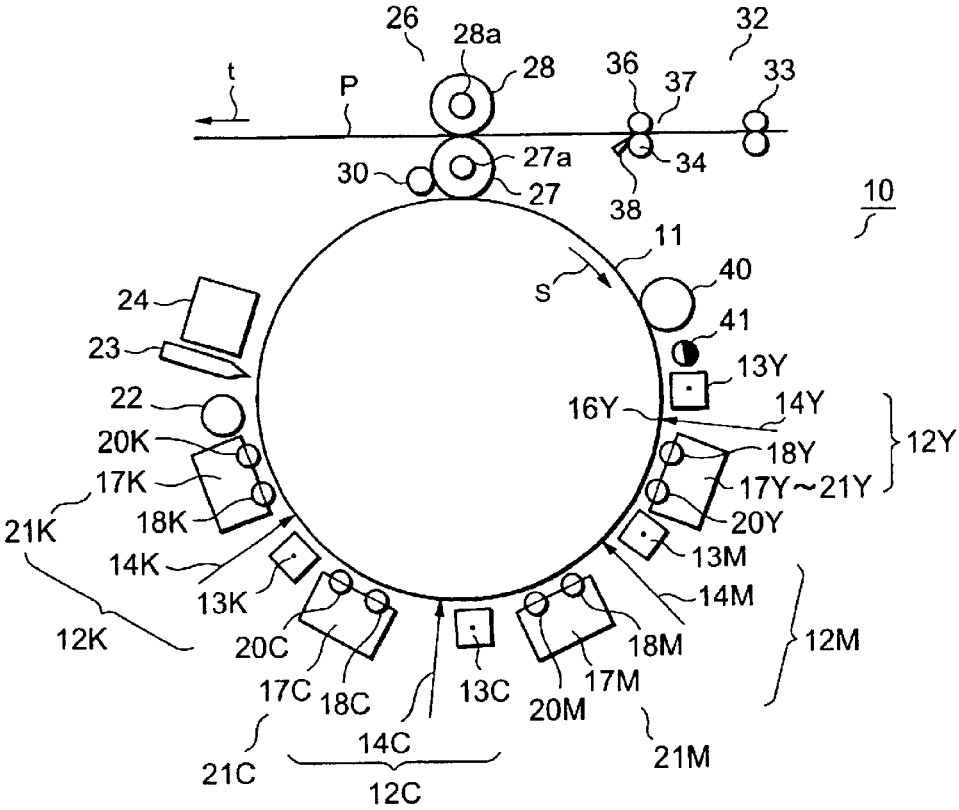
FIG. 2 is a schematic structural diagram showing an image forming portion of an electrophotographic apparatus according to the first embodiment of the present invention.

An embodiment of the invention will be thereinafter explained in detail using attached drawings. First of all, the first embodiment of the invention will be described. FIG. 2 shows an image forming portion 10 of an electrophotographic apparatus, which is a kind of image forming apparatuses. At the periphery of a photosensitive drum 11 comprising a conductive base of, for example, aluminum tube, which acts as an image forming material, an organic or amorphous silicon photosensitive layer formed on the conductive base, and preferably a protective layer of fluorine resin or silicone resin coated thereon, first to fourth image forming units 12Y to 12K are arranged in order. These image forming units 12Y to 12K form images with liquid developer of yellow (Y), magenta (M), cyan (C), and black (B) respectively on the photosensitive drum 11, along with rotation of the photosensitive drum 11 in the direction of the arrow s.

Each image forming unit 12Y to 12K has basically the same structure, although the color of respective liquid developer is different from each other. Therefore explanation will be carried out referring to the image forming unit 12Y of yellow (Y) located in upstream direction of the rotation of the photosensitive drum 11, and explanation for other image forming units 12M to 12K will be omitted, denoting the same portion by the same mark and giving it a suffix representing respective color.

The image forming unit 12Y of yellow (Y) has a charger 13Y comprising a well-known corona charger or scorotron charger etc. The image forming unit 12Y also comprises an exposing device with a laser irradiating device or a light emitting diode (LED) (not shown). The exposing device irradiates selectively an exposing light 14Y corresponding to a light signal of yellow (Y) in compliance with an image information onto an exposed portion 16Y of the photosensitive drum 11, in order to attenuate the potential of the exposed portion and to form an electrostatic latent image. Furthermore, the image forming unit 12Y is provided with a developing device 21Y comprising a development roller 18Y and a squeeze roller 20Y The development roller 18 accommodating liquid developer 17Y of yellow (Y) fed from a storage room (not shown) to supply the liquid developer 17Y to a surface of the photosensitive drum 11 under application of a bias voltage. The squeeze roller 20Y makes the excess liquid developer 17Y on the photosensitive drum 11 become a thin layer after development.

The liquid developer 17Y to 17K contain toner particles comprising mixtures of approximately 0.6 micrometer in average diameter, which are made of acrylic resin (e.g. a thermoplastic resin with glass transition point of 45° C. ) added by coloring pigment of yellow, magenta, cyan, or black, and charge controlling agent, dispersed by liquid carrier. The liquid carrier is a hydrocarbon system liquid carrier of non-conductive and non-polarized solvent (e.g. Isopar® L: produced by ExxonMobile Chemical Japan Pte. Ltd.). The toner particles are being charged in the liquid carrier. Consequently, the developing devices 21Y to 21K form a developed image by adhering selectively the toner particles charged in the liquid carrier to the surface of the photosensitive drum 11, in proportion to the electric field generated between the development rollers 18Y to 18K and the photosensitive drum 11.

A liquid removing roller 22, which removes excess liquid carrier remaining on the photosensitive drum 11 after development by means of the developing devices 21Y to 21K, is located downstream of each image forming unit 12Y to 12K on the periphery of the photosensitive drum 11. The liquid removing roller 22 contacts the photosensitive drum 11. An air knife 23 and a solvent collecting device 24 are provided at a downstream side of the liquid removing roller 22 on the periphery of the photosensitive drum 11. The air knife 23 is located adjacent to the photosensitive drum 11. And the air knife 23 blows dry air of 50 m/sec in velocity against the photosensitive drum 11 so as to evaporate compulsorily the excess liquid carrier. And a solvent collecting device 24 collects the evaporated excess liquid carrier.

At a downstream side of the solvent collecting device 24 on the periphery of the photosensitive drum 11, a transferring device 26 is provided. The transferring device 26 comprises an intermediate transfer roller 27 which is an intermediate transferring medium contacting the primary transfer position on the periphery of the photosensitive drum 11, and a backup roller 28 which makes the intermediate transfer roller 27 contacted under pressure with the photosensitive drum 11, contacting the secondary transferring position on the periphery of the photosensitive drum 11.

The intermediate transfer roller 27 accommodates a halogen lamp heater 27*a* therein, and a seamless elastic film 27*b* is formed on a surface of a hollow roller with 100 mm in outer diameter of SUS stainless steel. The elastic film 27*b* has a silicone resin bonding layer of 0.03 mm in thickness, inserted between a PET (polyethylene terephthalate) film of 0.1 mm in thickness and a silicone rubber layer of 0.2 mm in thickness with hardness (JIS-A) (hereinafter called hardness) of 50 as an elastic layer at the utmost surface thereof. Total load to the intermediate transfer roller 27 when transferring step is executed is 100 kg and the surface temperature thereof is 100° C. And the transfer roller 27 rotates at 110 mm/sec by a subordinate rotation in dependence upon the rotation of the photosensitive drum 11. The backup roller 28 comprises a hollow roller with 50 mm in outer diameter of SUS, accommodating the halogen lamp heater 28*a* therein. Total load to the backup roller 28 when transferring step is executed is 50 kg and the surface temperature thereof is 100° C.

The transferring device 26 transfers primarily a toner image formed on the photosensitive drum 11 to the intermediate transfer roller 27 by the aid of adhesion of the toner particles and pressure, and thereafter transfers the toner image secondarily to the paper p.

Figure 3:
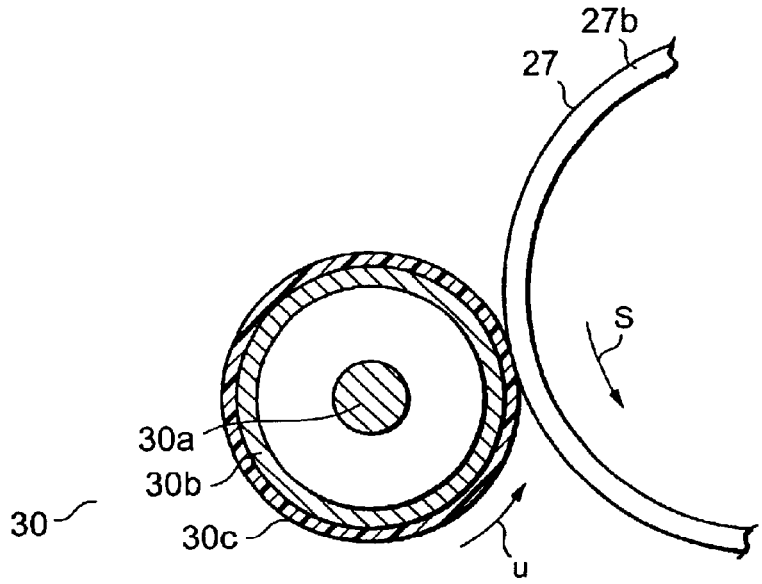
FIG. 3 is a schematic cross section showing an intermediate cleaning roller according to the first embodiment of the present invention.

An intermediate cleaning roller 30, which acts as the intermediate cleaning device, contacts a downstream side of the secondary transfer position on the periphery of the intermediate transfer roller 27. The intermediate cleaning roller 30 removes stuck material such as remaining toner left on the surface of the intermediate transferring roller 27 after the toner image has been transferred to the paper P, The intermediate cleaning roller 30 shown in FIG. 3 comprises a hollow aluminum roller 30*b* accommodating a halogen lamp heater 30*a* therein, and a surface layer 30*c* surrounding the aluminum roller 30*b*.

The surface layer 30*c* is made of styrene-acryl resin, which is the same kind as the toner particles, with transition point of 45 degrees Celsius, and has some adhesion. The surface layer 30*c* is coated around the aluminum roller 30*b* having a width thereof greater than that of the transferred region of the intermediate transfer roller 27 and a thickness of 300 micrometers. The surface of the intermediate cleaning roller 30 is heated to 100° C. so as to generate adhesion caused by softening of styrene-acryl resin of the surface layer 30*c* when cleaning is carried out. So that the surface of the intermediate transfer roller 27 can be kept clean because stuck material on the surface of the intermediate transfer roller 27 are transferred to the cleaning roller 30 by the aid of adhesion thereof by means of contact-rotation with the intermediate transfer roller 27.

Moreover, a photosensitive drum cleaner 40 to remove the residual toner and an erasing lamp 41 to discharge the remaining charge on the photosensitive drum 11, are provided at a downstream side of the transfer device 26 surrounding the photosensitive drum 11.

Figure 4:
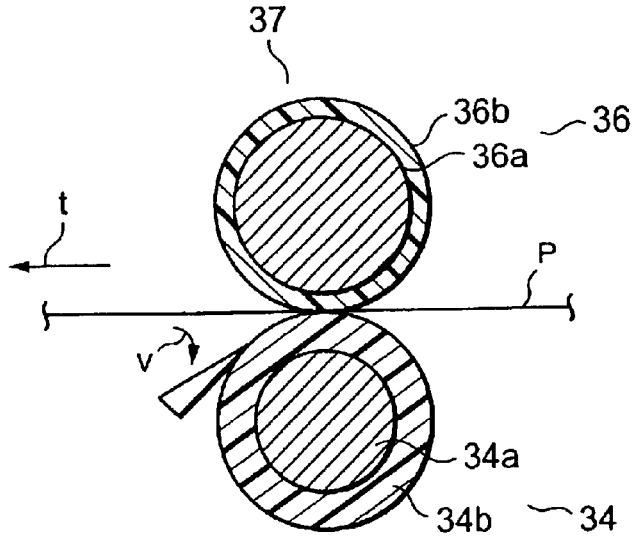
FIG. 4 is a schematic explanatory diagram showing a conveying roller according to the first embodiment of the present invention.

In the meanwhile, a conveying device 32 has a resist roller 33 and a pair of conveying rollers 37 comprising a paper cleaning roller 34 acting as the paper cleaning device and a counter roller 36 at a downstream side of the resist roller 33. The conveying device gets out the paper P from a paper feeder (not shown) and carries it to the secondary transferring position of the intermediate transfer roller 27 by synchronizing the toner image on the intermediate transfer roller 27. FIG. 4 shows the conveying rollers 37. The counter roller 36 is formed by a metallic shaft 36*a* covered with an ethylene-propylene rubber layer 36*b* of hardness 70. And the paper cleaning roller 34 is formed by a metallic shaft 34*a* covered with a urethane rubber layer 34*b* of hardness 30. Thus the surface of the paper cleaning roller 34 has adhesion of 2.4 gf/mm$^2$ in adhesion strength.

Figures 5, 6:
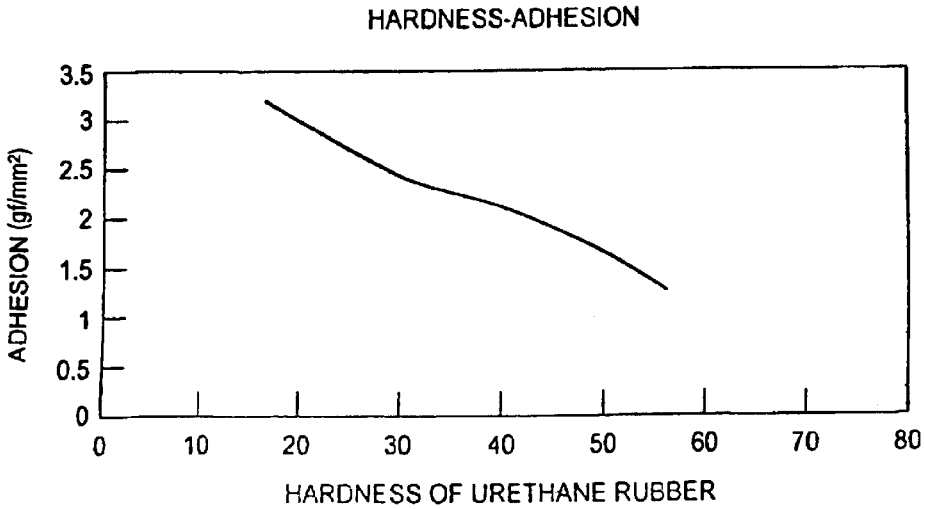
FIG. 5 shows the relation between hardness and adhesion strength of urethane rubber used for the first embodiment of the present invention (Table 1)
FIG. 6 is a graph showing the relation between hardness and adhesion strength of urethane rubber used for the first embodiment of the present invention.

Generally it is well known that adhesion of rubber becomes greater if hardness thereof becomes smaller. Using the adhesion strength as an index representing the adhesion of the urethane rubber, relation of the hardness of urethane rubber and the adhesion strength thereof is measured. FIG. 5 (Table 1) shows the result that is approximately directly proportional relation as shown in FIG. 6.

With regard to the paper cleaning roller 34, adhesion strength thereof for dust such as paper powder adhered to the contact surface of the paper P with the intermediate transfer roller 27 is higher than adhesion strength between the dust and the contact surface of the paper P. Thus the dust stuck to the contact surface of the paper P with the intermediate transfer roller 27 is adhered to the paper cleaning roller 34 side while the paper P passes through the conveying roller 37. Mark 38 denotes a removing claw to exfoliate the paper P from the paper cleaning roller 34. The removing claw turns to the direction of arrow v by means of a driver (not shown) in order to intervene between the paper cleaning roller 34 and the paper P only when the top of the paper P passes through the paper cleaning roller 34, and gets away from the paper cleaning roller 34 after the top of the paper P has passed through.

Next, the operation will be explained. When image forming process starts, the photosensitive drum 11 rotates in the direction of arrow s, and at the same time, developed image-forming operation by each image forming unit 12Y to 12K is carried out. Regarding each image forming unit 12Y to 12K, first of all, the photo sensitive drum 11 is charged uniformly to a predetermined voltage with the charger 13Y at the image forming unit 12Y of yellow (Y). Then, in compliance with the image information, the exposing light 14Y corresponding to the image information of yellow, which is irradiated from an exposing device (not shown), irradiates selectively the photosensitive drum 11 to form an electrostatic latent image corresponding to the yellow (Y) image on the photosensitive drum 11.

Subsequently the latent image is developed by the developing roller 18Y using the liquid developer 17Y, to form a developed image of yellow (Y) on the photosensitive drum 11. Thereafter, a surplus amount of the liquid developer 17Y on the photosensitive drum 11 is removed by the squeeze roller 20Y so as to make the liquid developer 17Y become a thin layer. In the same way, developed images of magenta (M), cyan (C), and black (K) are superimposed on the photosensitive drum 11 sequentially by the following image forming units 12M to 12K to form a full color toner image.

The surplus amount of the liquid carrier is removed from the developed image on the photosensitive drum 11 through the porous elastic roller 22, the drying nozzle 23 and the solvent collecting device 24. Then the developed image is dried and reaches the transferring device 26. The full color toner image on the photosensitive drum 11 is transferred primarily to the intermediate transfer roller 27 pressed compulsorily to the photosensitive drum 11 side by the aid of the backup roller 28, and then transferred secondarily to the paper P conveyed from the intermediate transfer roller 27 in the direction of arrow t, to complete a full color image on the paper P.

During the operation mentioned above, the intermediate cleaning roller 30 is being slid in the direction of arrow u by means of a driver (not shown). After the secondary transferring step has finished, the intermediate cleaning roller 30 whose adhesion strength becomes 2.4 gf/mm$^2$ thanks to softening of the surface layer 30*b* when it is heated at 100 degrees Celsius, presses against the intermediate transfer roller 27 and rotates so that the stuck material on the surface of the intermediate transfer roller 27 can be adhered to the intermediate cleaning roller 30 side and removed therefrom.

On the other hand, the paper P conveyed by the paper conveying device 32 contacts the paper cleaning roller 34 at the conveying roller 37. Thus dust stuck to the contact surface side, which faces the intermediate transfer roller 27, of the paper P is adhered to the paper cleaning roller 34 side approximately one hundred percent and removed. Thereafter the paper P is separated from the paper cleaning roller 34 by the aid of the removing claw 38, and reaches the secondary transferring position. Therefore no dust is adhered to the intermediate transfer roller 27 side from the paper P when the toner image on the intermediate transfer roller 27 is transferred secondarily to the paper P. After the secondary transferring step has finished, only remaining toner of transferring residue of the toner is recognized slightly on the surface of the intermediate transfer roller 27, and the transferring residue of the toner is adhered to the surface side of the intermediate cleaning roller 30 and removed.

After the photosensitive drum 11 has transferred primarily the full color toner image to the intermediate transfer roller 27, residual toner is cleaned by the cleaner 40 and residual charge is erased by the erase lamp 41. Thus a sequence of image forming process finishes and the drum 11 stands by for the next image forming process.

When maintenance is put into execution between the image forming processes, or if the adhesion strength of the surface of the paper cleaning roller 34 becomes deteriorated, the surface of the paper cleaning roller 34 is wiped out with alcohol or water to recover the adhesion strength as the initial condition. If the paper cleaning roller 34 comes to end of life after predetermined number of the image forming processes have been executed, it is exchanged for a new one as needed. Also, if the adhesion strength of the surface of the intermediate cleaning roller 30 becomes deteriorated, the surface is wiped out with alcohol or water to recover the adhesion strength as the initial condition. If it comes to end of life, it is exchanged for a new one as needed.

In the first embodiment, endurance test for the paper cleaning roller 34 and the intermediate cleaning roller 30 has been carried out using the A-4 size paper P. As a result, the paper cleaning roller 34 maintained sufficient adhesion strength, which could adhere and remove well the dust of the paper P, even after 10,000 sheets passed it through. Thereafter the surface thereof was wiped out with alcohol or water, and the adhesion strength recovered as the initial condition. In relation to the intermediate cleaning roller 30, by wiping out the surface of the paper cleaning roller 34 with alcohol or water every 10,000 sheets to recover the adhesion strength, it could clean well the intermediate transfer roller 27 even after 30,000 sheets passed it through.

According to the structure mentioned above, in the first embodiment, by removing the dust of the paper P with the paper cleaning roller 34 before the paper reaches the secondary transferring position, no dust can adhere to the intermediate transfer roller 27 side during the secondary transferring step, and moreover no dust can adhere to the surface of the intermediate cleaning roller 30. Consequently deterioration of the adhesion strength of the intermediate cleaning roller 30 caused by adhesion of dust ever occurred can be prevented, and adhesion of the surface of the intermediate cleaning roller 30 is well maintained. As a result, the intermediate transfer roller 27 is cleaned well by the intermediate cleaning roller 30, and a developed image of good quality can be obtained. Furthermore, maintainability of the intermediate cleaning roller 30 can be improved and economical efficiency can also improve by achievement of long life of the intermediate cleaning roller 30.

If the paper cleaning roller 34 also serves as the conveying roller 37 like the first embodiment, opportunity for the paper P to contact the conveying device until it reaches the secondary transferring position is diminished, so that generating amount of paper powder can be decreased. Consequently, the paper cleaning roller 34 and the intermediate cleaning roller 30 can be further improved with regard to maintainability and even life duration thereof.

Though styrene-acryl resin, which is the same as the toner particles, was employed as the surface layer 30*c* of the intermediate cleaning roller 30 in the first embodiment, any other resin that generates adhesion strength by heating, e.g. acryl resin, polyolefin resin, polyester resin or polystyrene resin, can be utilized. Furthermore, though the halogen lamp heater 30*a* was used as the heating means for the intermediate cleaning roller 30, an infrared lamp, a surface heater like a ceramic heater, or a ribbon heater such as a coated alloy heater like nichrome wire or kanthal wire can be available.

Figure 7:
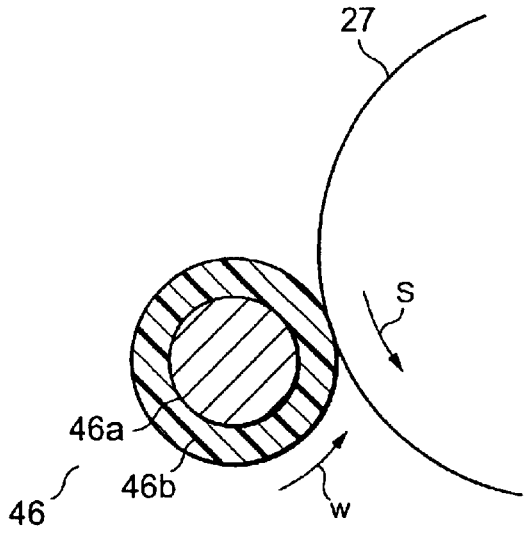
FIG. 7 is a schematic cross section showing an intermediate cleaning roller according to the second embodiment of the present invention.

Referring to the second embodiment as shown in FIG. 7, the present invention will be explained. Because the second embodiment is the same as the above-mentioned first embodiment except for the structure of the intermediate cleaning roller, each portion that is the same as the portion of the first embodiment is denoted by the same mark and explanation thereof will be omitted.

In the second embodiment, the intermediate cleaning roller 46, which is the intermediate transfer cleaning device contacting a downstream side of the secondary transferring position of the intermediate transfer roller 27, is formed by a metallic shaft 46*a* whose surface is coated with urethane rubber layer 46*b* of hardness 30 having a width larger than that of the transferring region of the intermediate transfer roller 27. After the toner image has been transferred secondarily to the paper P, the intermediate cleaning roller 46 contacts the intermediate transfer roller 27 and rotates, and then stuck material on the surface of the intermediate transfer roller 27 is removed to the urethane rubber layer 46*b* side in order to clean the surface of the intermediate transfer roller 27.

At that time, just as the first embodiment, dust stuck to the contact surface side, which faces the intermediate transfer roller 27, of the paper P conveyed to the secondary transferring position is removed approximately one hundred percent to the paper cleaning roller 34 side by adhesion. Consequently no dust adheres to the intermediate transfer roller 27 side during the secondary transferring step, and moreover no dust adheres to the intermediate cleaning roller 46 while the intermediate transfer roller 27 is cleaned, so that adhesion of the surface of the intermediate cleaning roller 46 can be well maintained.

In the second embodiment, endurance test for the intermediate cleaning roller 46 is carried out with the A-4 size paper P. As a result, the intermediate cleaning roller 46 maintained sufficient adhesion strength, which could clean well the intermediate transfer roller 27, even after 10,000 sheets passed it through. Furthermore, by wiping out the surface of the paper cleaning roller 34 and the surface of the intermediate cleaning roller 46 with alcohol or water every 10,000 sheets to recover the adhesion strength, it could clean well the intermediate transfer roller 27 for a long time.

In accordance with the structure mentioned above, adhering of dust to the intermediate transfer roller 27 side and furthermore adhering of dust to the surface of the intermediate cleaning roller 46 can be prevented by removing dust on the paper P by means of the paper cleaning roller 34 in the second embodiment like the aforementioned first embodiment. So that adhesion of the surface of the intermediate cleaning roller 46 can be well maintained. In consequence, the intermediate cleaning roller 46 can clean favorably the intermediate transfer roller 27, and the developed image of good quality can be obtained. In addition, economical efficiency is improved owing to improvement of maintainability and life duration of the intermediate cleaning roller 46.

The intermediate cleaning roller 46 is provided with the urethane rubber layer 46*b* on the surface thereof in the second embodiment mentioned above, but the invention is not limited to this. Any other material that is heat resistive and have adhesion capable of removing stuck material on the intermediate transferring medium, e.g. silicone rubber, ethylene-propylene rubber, butadiene-styrene rubber, chloroprene rubber, butyl rubber or ethylene vinyl acetate copolymer rubber can also be adopted.

Figure 8:
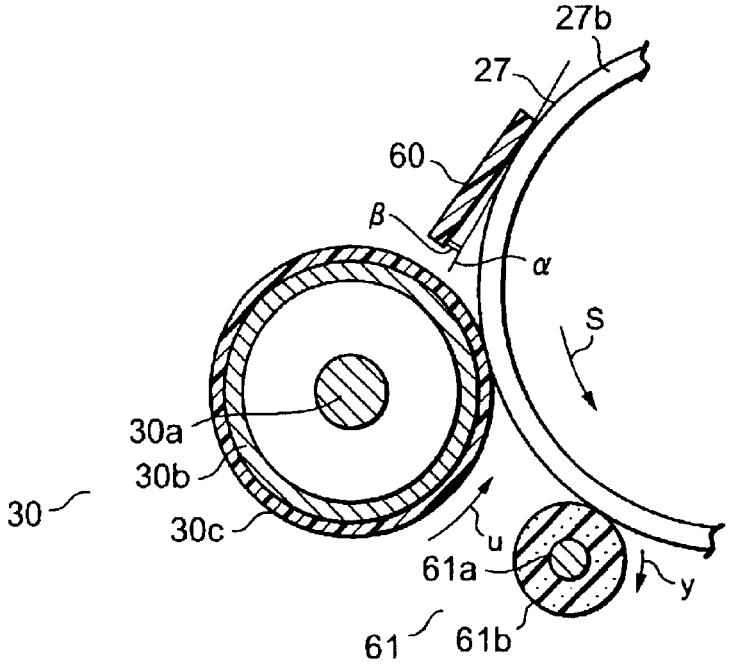
FIG. 8 is a schematic cross section showing a cleaning blade, an intermediate cleaning roller, and a coating roller according to the third embodiment of the present invention.

Referring to the third embodiment as shown in FIG. 8, the present invention will be explained. The third embodiment further comprises a cleaning blade and a coating roller to improve ability of cleaning of the intermediate transfer roller in the first embodiment. Because any other portion is the same as the above-mentioned first embodiment, each portion that is the same as that of the first embodiment is denoted by the same mark and explanation thereof will be omitted.

In the third embodiment, the cleaning blade 60 acting as a scraping device touches a downstream side of the secondary transferring position surrounding the intermediate transfer roller 27 in such a manner as to be able to either touch it or depart from it. The coating roller 61 acting as a coating material, which moves following the intermediate roller 27, touches a downstream side of the secondary transferring position surrounding the intermediate transfer roller 27 in such a manner as to be able to either touch it or depart from it. The cleaning blade 60 has a plate shaped tip of fluorine-contained polymer of thickness of approx. 2 mm, and contacts the intermediate transfer roller 27 at an angle ($\beta$) of 30 degrees or less to the tangential line ($\alpha$) of the intermediate transfer roller 27.

The coating roller 61 is, for example OIL SUPPLY ROLLER (trade mark of GORE-TEX® Inc.), and sponge portion 61*b* containing silicone oil, which is a cleaning agent, is provided surrounding the shaft 61*a*. The sponge portion 61*b* has two layers: i.e. the base layer is oil sustaining layer and the surface layer is GORE-TEX® (trade mark of GORE-TEX® Inc.) complex layer.

When image forming process begins to take place, the cleaning blade 60 and the coating roller 61 touch the intermediate transfer roller 27. After the full color toner image on the intermediate transfer roller 27 is transferred secondarily to the paper P, stuck material on the surface of the intermediate transfer roller 27 are firstly scraped off with the cleaning blade 60. Then, stuck material still remaining slightly on the intermediate transfer roller 27 are adhered to the intermediate cleaning roller 30 side and removed there from. Thereafter, with the coating roller 61 rotating in the direction of arrow y following the intermediate transfer roller 27, a very minute amount of silicone oil is fed to the intermediate transfer roller 27 to prevent deterioration of the transferring property of the surface of the intermediate transfer roller 27, so that durability of transferring property can be ameliorated.

At that time, just as the first embodiment, dust stuck to the contact surface side, which faces the intermediate transfer roller 27, of the paper P conveyed to the secondary transferring position is removed approximately one hundred percent to the paper cleaning roller 34 side by adhesion. Consequently no dust adheres to the intermediate transfer roller 27 side during the secondary transferring step, and moreover no dust adheres to the intermediate cleaning roller 30 while the intermediate transfer roller 27 is cleaned, so that adhesion of the surface of the intermediate cleaning roller 30 can be favorably maintained.

Figures 9, 10:
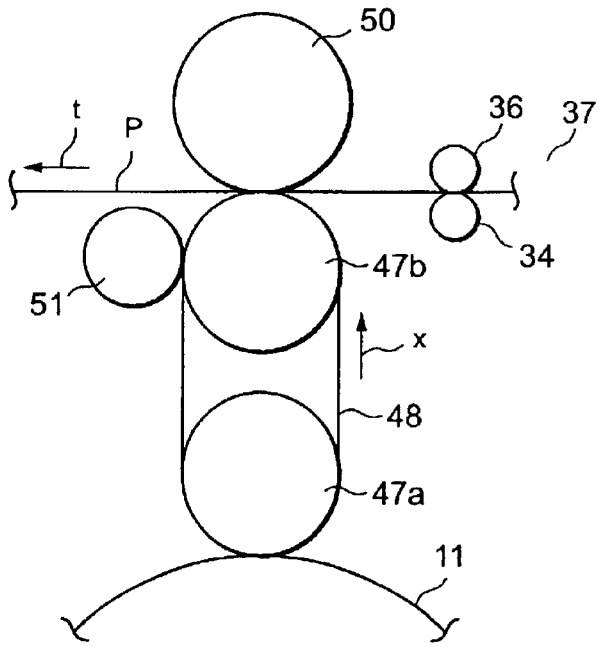
FIG. 9 shows the relation between structure and exchange life of an intermediate cleaning roller, when a paper cleaning roller, a cleaning blade, and an oil coating roller are used in the first and third embodiments of the present invention (Table 2)
FIG. 10 is a schematic diagram showing an intermediate transfer medium of another embodiment of the present invention.

Measured result about correlation between exchange life of the intermediate cleaning roller 30 and the following cases is shown in FIG. 9 (Table 2): i.e. when the paper cleaning roller 34 in the first embodiment is solely used; when both the paper cleaning roller 34 and the cleaning blade 60 in the third embodiment are used; and when the paper cleaning roller 34, the cleaning blade 60 and the oil coating roller 61 are all used. Here, the exchange life of the intermediate cleaning roller 30 is defined as number of papers that get good transferred images having 98% or more of transferring rate until the intermediate cleaning roller 30 is exchanged for a new one.

In accordance with the structure mentioned above, adhering of dust to the intermediate transfer roller 27 side and furthermore adhering of dust to the surface of the intermediate cleaning roller 30 can be prevented by removing dust on the paper P by the aid of the paper cleaning roller 34 in the second embodiment like the aforementioned first embodiment. So that adhesion of the surface of the intermediate cleaning roller 30 can be well maintained. Furthermore, because stuck material on the surface of the intermediate transfer roller 27 are scraped off by the cleaning blade 60 before cleaning by the intermediate cleaning roller 30, load to the intermediate cleaning roller 30 can be alleviated. Therefore, since stuck material on the intermediate cleaning roller 30 can be diminished, life duration of the intermediate cleaning roller 30 improves as shown in FIG. 9.

On the other hand, regarding to the intermediate transfer roller 27, life duration thereof can be improved because stuck material on the surface thereof is almost completely removed by the cleaning blade 60 and the intermediate cleaning roller 30. Furthermore, after cleaning has finished, coating the intermediate transfer roller 27 with silicone oil is planned to protect the surface thereof, so that the surface of the intermediate transfer roller 27 is prevented from deteriorating. That leads to further amelioration of life duration thereof.

In the third embodiment, fluorine-contained polymer is utilized as the material for the cleaning blade 60, but this is not the limitation for the invention. Super polymer polyethylene, PPS (polyphenylene sulfide) resin, polyester resin, aramid resin, polyimide-polyamide resin, polyimide resin, polyacetal resin, polyether-etherketone resin, etc. can also be employed. In addition, it is desirable for the material of the cleaning blade 60 to have high hardness (Rockwell hardness: R50 to 130), low dynamic friction coefficient (0.04 to 0.35) and low abrasion (0.1 to 0.35 against steel). The thickness of the cleaning blade 60 should be 3 mm or less, and no other limitations thereto exist.

The present invention is not limited to the embodiments mentioned above, but possible to change any matters within the intention thereof. The structure of the intermediate transfer medium is not necessarily roller-shaped, but can be an intermediate transfer belt 48 for example showing FIG. 10 that is hung between first drive roller 47*a* and second drive roller 47*b* of such as metal, and turns in the direction of arrow x. In this another embodiment, the intermediate transfer belt 48 is pressed against the photosensitive drum 11 at the primary transferring position by the first drive roller 47*a*, and pressed by the backup roller 50 at the secondary transferring position supported by the second drive roller 47*b*.

Thus the toner image on the photo sensitive drum 11 is transferred primarily to the intermediate transfer belt 48 at the primary transferring position pressed by the first drive roller 47*a,* then transferred secondarily from the intermediate transfer belt 48 to the paper P at the secondary transferring position supported by the second drive roller 47*b.* And finally the full color image is accomplished on the paper P. After the secondary transferring step has finished, stuck material on the surface of the intermediate transfer belt 48 is adhered to and removed by the adhesive intermediate cleaning roller 51. The intermediate transfer belt 48 may comprise only an elastic material such as silicone resin, or may be a structure having two layers or more, which has a substrate of another elastic material with higher hardness or metallic material, and a silicone resin layer on the surface of the substrate.

The paper cleaning device may not necessarily combine with the conveying device, but can have solely cleaning function. In this case, using an elastic material such as sponge coated with aqueous acryl emulsion (aqueous adhesive) as the material thereof, dust of the paper can be adhered and removed.

The material for the paper cleaning device is not limited to the above. For example, when urethane rubber layer is used as the surface material of the paper cleaning device, hardness of the urethane rubber layer is enough to be adhesion strength, which can remove dust adhered to the paper to the paper cleaner side, compared to adhesion strength of dust to the paper. Sufficient adhesion strength can be obtained if hardness is 50 or less. However if hardness is low and adhesion strength becomes too strong, ability of separation for the paper P gets worse. Hardness of 6 to 50 is therefore favorable for the urethane rubber layer.

The material for the surface of the paper cleaning device is not limited to the urethane rubber layer. Any material that have adhesion strength capable of removing dust adhered to the paper to the paper cleaning device side, compared to adhesion strength of dust to the paper, e.g. silicone rubber, ethylene-propylene rubber, styrene-butadiene rubber, chloroprene rubber, butyl rubber, ethylene-vinyl acetate copolymer rubber, nitrile-butadiene rubber, polyethylene chloride rubber, or acryl rubber may be employed.

In addition, the structure, the material etc. of the intermediate transfer cleaning device are also not limited to the above. For instance, it is favorable that the thickness of the surface layer is 0.1 mm to 10 mm, which has enough elasticity and makes loss of heat conduction of the heating device be not too large. The material of the surface layer of the intermediate transfer cleaning device is not limited to the material which generates adhesion by heating, but any material of adhesion even at room temperature, such as silicone rubber, urethane rubber, ethylene-propylene rubber, styrene-butadiene rubber, chloroprene rubber, butyl rubber, nitrile-butadiene rubber, or acryl rubber can be utilized.

When the stuck material on the intermediate transfer medium is removed with both the intermediate transfer cleaning device and the scraping device, it may firstly be adhered to and removed by the intermediate transfer cleaning device and then remaining stuck material may be removed by the scraping device.

As described above in detail, in accordance with the present invention, the stuck material on the paper is removed in advance before the paper reaches the transferring position where the paper contacts the intermediate transfer medium. Therefore, when the toner image on the intermediate transfer medium is transferred to the paper, the stuck material such as paper powder on the paper does not adhere to the intermediate transfer medium and moreover to the intermediate transfer cleaning device, so that the adhesion of the surface of the intermediate transfer cleaning device can be well maintained. Because the intermediate transfer medium is favorably cleaned, developed images of good quality can be obtained and economical efficiency can improve thanks to improvement of maintainability and life duration of the intermediate transfer cleaning device.

What is claimed is:

1. An image forming apparatus comprising:

an image forming unit configured to form an electrostatic latent image on a surface of an image forming substrate;

a developing device configured to supply liquid developer to the electrostatic latent image to form a developed image on the image forming substrate;

an intermediate transfer medium having a primary transferring position to which the developed image on the image forming substrate is transferred primarily by contacting the image forming substrate and a secondary transferring position transferring secondarily the developed image to a paper by contacting the paper;

an intermediate transfer medium cleaning device which has an adherent surface adhering and removing first material stuck to a surface of the intermediate transfer medium, and which contacts the intermediate transfer medium in a place after passing through the secondary transferring position and before passing through the primary transferring position; and a paper cleaning device contacting the contact surface of the paper and including an adherent surface adhering and removing second material stuck to a contact surface of the paper, the paper cleaning device positioned in a conveying path of a conveying device configured to transport the paper to the secondary transferring position of the intermediate transfer medium, wherein an adhesion strength between the surface of the paper cleaning device and the second stuck material is greater than an adhesion strength between the surface of the intermediate transfer medium and the second stuck material.

2. The image forming apparatus according to claim 1, wherein the paper cleaning device combines with the conveying device.

3. The image forming apparatus according to claim 1, wherein an adhesion strength between the second stuck material and the paper cleaning device is greater than an adhesion strength between the contact surface of the paper and the second stuck material.

4. The image forming apparatus according to claim 1, wherein the intermediate transfer cleaning device comprises a surface layer of adhesive material and a heating device to heat the surface layer.

5. The image forming apparatus according to claim 1, wherein the image forming apparatus further comprises a scraping device to scrape the first stuck material on the surface of the intermediate transfer medium, which contacts the intermediate transfer medium in a place after passing through the secondary transferring position and before passing through the primary transferring position.

6. The image forming apparatus according to claim 1, wherein the image forming apparatus further comprises a coating device to coat a cleaning agent on the surface of the intermediate transfer medium, which contacts the intermediate transfer medium in a place after passing through the secondary transferring position and before passing through the primary transferring position.

7. The image forming apparatus according to claim 6, wherein the image forming apparatus further comprises a scraping device to scrape the first stuck material on the surface of the intermediate transfer medium, which contacts the intermediate transfer medium in a place after passing through the secondary transferring position and before passing through the primary transferring position.

8. An image forming apparatus comprising:

an image forming unit configured to form an electrostatic latent image on a surface of an image forming substrate;

a developing device configured to supply liquid developer to the electrostatic latent image to form a developed image on the image forming substrate;

an intermediate transfer roller having a primary transferring position which the developed image on the image forming substrate is transferred primarily by contacting the image forming substrate and a secondary transferring position transferring secondarily the developed image to a paper by contacting the paper;

an intermediate transfer cleaning roller which has an adherent surface adhering and removing first material stuck to a surface of the intermediate transfer roller, and which contacts the intermediate transfer roller in a place after passing through the secondary transferring position and before passing through the primary transferring position; and a paper cleaning roller contacting the contact surface of the paper an including an adherent surface adhering and removing second material stuck to a contact surface of the paper, the paper cleaning roller positioned in a conveying path of a conveying device configured to transport the paper to the secondary transferring position of the intermediate transfer roller, wherein an adhesion strength between the surface of the paper cleaning roller and the second stuck material is greater than an adhesion strength between the surface of the intermediate transfer roller and the second stuck material.

9. The image forming apparatus according to claim 8, wherein the paper cleaning roller combines with the conveying device.

10. The image fonning apparatus according to claim 8, wherein an adhesion strength between the second stuck material and the paper cleaning roller is greater than an adhesion strength between the contact surface of the paper and the second stuck material.

11. The image forming apparatus according to claim 8, wherein the intermediate cleaning roller comprises a hollow roller accommodating a heater therein and an adhesive material on a surface of the hollow roller.

12. The image forming apparatus according to claim 8, wherein the image forming apparatus further comprises a blade device to scrape the first stuck material on the surface of the intermediate transfer roller, which contacts the intermediate transfer roller in a place after passing through the secondary transferring position and before passing through the primary transferring position.

13. The image forming apparatus according to claim 8, wherein the image forming apparatus further comprises a coating roller to coat a cleaning agent on the surface of the intermediate transfer roller, the intermediate transfer roller in a place after passing through the secondary transferring position and before passing through the primary transferring position.

14. The image forming apparatus according to claim 13, wherein the image forming apparatus further comprises a cleaning blade to scrape the first stuck material on the surface of the intermediate transfer roller, which contacts the intermediate transfer roller in a place after passing through the secondary transferring position and before passing through the primary transferring position.

15. An image forming method comprising:

developing an image by supplying liquid developer to an electrostatic latent image formed on an image forming substrate;

primary transferring the developed image from the image forming substrate to an intermediate transfer medium by contacting the intermediate transfer medium with the image forming substrate;

secondary transferring the developed image from the intermediate transfer medium to a paper by contacting the paper with the intermediate transfer medium;

adhering and removing first material stuck to a contact surface of the paper by contacting an adherent surface of a paper cleaning device to the contact surface of the paper, the paper cleaning device positioned in a conveying path that transports the paper to the intermediate transfer medium; and adhering and removing second material stuck to a surface of the intermediate transfer medium by contacting an adherent surface of an intermediate transfer medium cleaning device after the secondary transferring step, wherein an adhesion strength between the surface of the paper cleaning device and the first stuck material is greater than an adhesion strength between the surface of the intermediate transfer medium and the first stuck material.

16. The image forming method according to claim 15, wherein the adhering and removing first material step and a paper conveying are carried out simultaneously by the paper cleaning device.

17. The image forming method according to claim 15, wherein the adhering and removing first material step adheres the first stuck material on the contact surface of the paper to the paper cleaning device by the aid of an adhesion strength between the first stuck material and the paper cleaning device that is greater than an adhesion strength between the contact surface of the paper and the first stuck material.

18. The image forming method according to claim 15, wherein the adhering and removing second material step is carried out by heating the intermediate cleaning device.

19. The image forming method according to claim 15, wherein the image forming method further comprises scraping the second stuck material on a surface of the intermediate transfer medium in a place after the secondary transferring step.

20. The image forming method according to claim 15, wherein the image forming method further comprises coating a cleaning agent on the surface of the intermediate transfer medium after the adhering and removing second material step.

21. The image forming apparatus according to claim 1, wherein the developed image is transferred from the image forming substrate to the intermediate transfer medium by adhesion and pressure.

22. The image forming apparatus according to claim 8, wherein the developed image is transferred from the image forming substrate to the intermediate transfer roller by adhesion and pressure.

23. The image forming method according to claim 15, wherein the primary transferring transfers the developed image from the image forming substrate to the intermediate transfer medium by adhesion and pressure.

24. The image forming apparatus according to claim 1, wherein a hardness of the surface of the paper cleaning device is less than or equal to 50.

25. The image forming apparatus according to claim 8, wherein a hardness of the surface of the paper cleaning roller is less than or equal to 50.

26. The image forming method according to claim 15, wherein a hardness of the surface of the paper cleaning device is less than or equal to 50.

* * * * *